US008710914B1

(12) United States Patent
Guhados et al.

(10) Patent No.: US 8,710,914 B1
(45) Date of Patent: Apr. 29, 2014

(54) VOLTAGE REGULATORS WITH IMPROVED WAKE-UP RESPONSE

(71) Applicant: SanDisk Technologies Inc., Plano, TX (US)

(72) Inventors: Shankar Guhados, Fremont, CA (US); Sung-En Wang, San Jose, CA (US); Feng Pan, Fremont, CA (US); Sagar Magia, Milpitas, CA (US); Jonathan H. Huynh, San Jose, CA (US)

(73) Assignee: SanDisk Technologies Inc., Plano, TX (US)

( * ) Notice: Subject to any disclaimer, the term of this patent is extended or adjusted under 35 U.S.C. 154(b) by 0 days.

(21) Appl. No.: 13/762,627

(22) Filed: Feb. 8, 2013

(51) Int. Cl.
*G05F 1/10* (2006.01)
*G05F 1/46* (2006.01)

(52) U.S. Cl.
CPC ..... *G05F 1/465* (2013.01)
USPC ..... 327/540

(58) Field of Classification Search
CPC ..... G05F 3/262; G05F 1/465
USPC ..... 327/538, 540, 541, 543, 544
See application file for complete search history.

(56) References Cited

U.S. PATENT DOCUMENTS 5,721,485 A 2/1998 Hsu et al.
5,910,738 A * 6/1999 Shinohe et al. ..... 327/108
7,206,230 B2 4/2007 Li et al.
7,319,314 B1 * 1/2008 Maheshwari et al. ..... 323/313
7,372,320 B2 5/2008 Pan
8,294,442 B2 * 10/2012 Zhu ..... 323/281
2011/0133710 A1 6/2011 Pancholi et al.
2011/0181257 A1 7/2011 Pancholi et al.

OTHER PUBLICATIONS

U.S. Appl. No. 13/750,794 entitled "LDO/HDO Architecture Using Supplementary Current Source to Improve Effective System Bandwidth," filed Jan. 25, 2013, 21 pages.
U.S. Appl. No. 13/750,808 entitled "Improvements in Settling Time and Effective Band Width for Op-Amps Using Miller Capacitance Compensation," filed Jan. 25, 2013, 20 pages.

* cited by examiner

*Primary Examiner* — Sibin Chen
(74) *Attorney, Agent, or Firm* — Davis Wright Tremaine LLP

(57) ABSTRACT

Techniques are presented for improving the wake-up response of voltage regulation circuits. A first set of techniques relate to the inputs an op-amp in a regulation circuit. In regulated operation, one input receives feedback from the regulator's output. Instead, during reset, after resetting the op-amp's output node to the supply level, this input of op-amp is instead connected to ground in order to increase the amount of tail current through the op-amp in order to more quickly bring down the op-amp's output node. A detection circuit is introduced to determine when the op-amp's input is reconnected to receive feedback. In a complementary sets of techniques, when the circuit on which the regulator is formed receives an enable signal and the output of the regulator will be needed for an operation, and when the regulator is not yet back at operating levels, its supply is temporarily shorted to the supply level.

26 Claims, 5 Drawing Sheets

VOLTAGE REGULATORS WITH IMPROVED WAKE-UP RESPONSE

FIELD OF THE INVENTION

This invention pertains generally to the field of voltage regulation circuits and, more particularly, to the wake-up behavior of such circuit.

BACKGROUND

A voltage regulation circuit is an analog block that provides a regulated power supply output for various circuit blocks of an integrated circuit. During stand-by or reset periods, these regulator circuits are frequently reset to reduce power consumption, being enabled to provide the expected output voltages during the circuits operation. The enabling of these regulators from stand-by or reset is termed as "wake-up". A key specification for the regulators is the time required for wake-up. A number of techniques are known in the prior art for reducing wake-up times; however, in many high performance applications the wake-up behavior of these previous approaches is still often below desired levels.

SUMMARY OF THE INVENTION

According to a general aspect of the invention, a voltage regulation system includes a regulator section and detection circuitry. The regulator section has a power transistor connected between a supply level and the output of the voltage regulation system; a feedback path to receive feedback from the output of the voltage regulation system; and an operational amplifier having first and second inputs and having an output connected to the gate of the power transistor. The first input of the operational amplifier is connected to a reference level and the regulator section also has switching circuitry, whereby the second input of the operational amplifier is selectively connectable to either receive feedback from a the feedback path or to ground. The detection circuitry is connected to the switching circuitry and to receive the output of the operational amplifier and an enable signal, whereby the second input of the operational amplifier is connected to ground when the enable signal is asserted and the voltage level on the output of the operational amplifier is above a first regulation level and is otherwise connected to receive the feedback.

Other general aspects include a method of resetting a voltage regulation circuit, the voltage regulation circuit including a power transistor connected between a supply level and the output node of the voltage regulation circuit, and an operational amplifier having first and second inputs and having an output connected to the gate of the power transistor, where the first input of the operational amplifier is connected to a reference level. The method includes setting the output of the operational amplifier to the supply level; subsequently setting the second input of the operational amplifier to ground; while the second input of the operational amplifier is connected to ground, determining when the output voltage of the operational amplifier falls below a regulation level; and in response to the output voltage of the operation falling below the first regulation level, connecting the second input of the operation amplifier to receive feedback from the output of the voltage regulation circuit.

Other aspects present a voltage regulation circuit that forms a component of an integrated circuit. The voltage regulation circuit is connected between a supply voltage and ground and is also connected to receive a reference voltage and generate from it a regulated output voltage at an output node. The method includes receiving a chip enable signal at the integrated circuit and, in response to the chip enable signal being asserted, determining whether the voltage regulation circuit is active. In response to determining that the voltage regulation circuit is not active, the voltage regulation circuit is activated and, subsequently to the enable signal being asserted, a command to perform an operation using the regulated output voltage is received at the integrated circuit. It is determined whether the command is received within a first interval after activating the voltage regulation circuit and, in response to the command being received within the first interval, the output node is shorted to the supply voltage.

Various aspects, advantages, features and embodiments of the present invention are included in the following description of exemplary examples thereof, whose description should be taken in conjunction with the accompanying drawings. All patents, patent applications, articles, other publications, documents and things referenced herein are hereby incorporated herein by this reference in their entirety for all purposes. To the extent of any inconsistency or conflict in the definition or use of terms between any of the incorporated publications, documents or things and the present application, those of the present application shall prevail.

DETAILED DESCRIPTION

Figure 1:
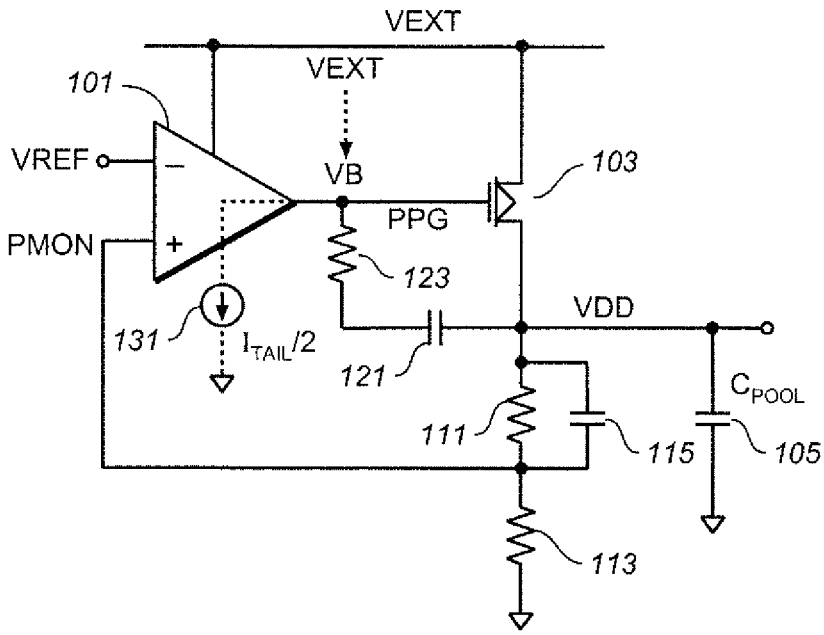
FIG. 1 is an example of regulator circuit.

Considering the wake-up behavior of voltage regulation circuits further, FIG. 1 shows an example of voltage regulator that can be used to discuss the wake-up behavior. An op-amp 101 is connected between the supply level VEXT and ground, with an output connected (at node PPG) to drive the gate of a power transistor 103 that is connected between the supply level and the output node of the circuit to supply the level VDD. A first input of the op-amp is connected to a reference level VREF and the second input is connected to receive feedback PMON from the output at VDD. Here the feedback is from a node of a divider, formed of the resistances 111 and 113 and a capacitance 115. A capacitance $C_{POOL}$ 105 is connected between VDD and ground and Miller compensation from a resistor 123 in series with capacitor 123 are used in this example. A number of other variations could be used, the arrangement of FIG. 1 is a useful embodiment for this discussion. (More detail of voltage regulation circuits, their operation and applications that can be applied in the following can be found in: U.S. Pat. No. 7,372,320; US patent publications US-2011-0133710-A1 and US-2011-0181257-A1; and U.S. patent application Ser. Nos. 13/750,794 and 13/750,808)

Figure 2:
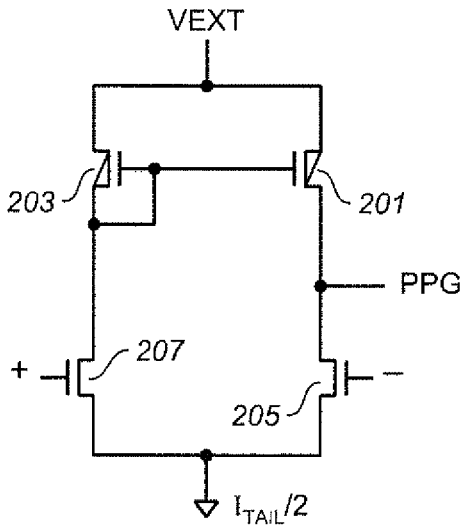
FIG. 2 is a more detailed version of the op-amp element.

To speed up wake-up operation, at reset, the PPG node can be initialized to VEXT and then discharged to the desired VB level for wake-up. The rate at which this node discharges, though, is limited by using only about half of the tail current ($I_{TAIL}$, the amount of current flowing though the op-amp to ground), as illustrated schematically at 131. This can be seen by referring to FIG. 2, which shows an basic op-amp circuit. The left leg has a PMOS 203 connected in series with an NMOS 207 connected between VEXT and ground, where the + input is connected to the gate of NMOS 207. The right leg has a PMOS 201 connected in series with an NMOS 205 connected between VEXT and ground, where the – input is connected to the gate of NMOS 205. The output is taken from a node between PMOS 201 and NMOS 205. As the PMOS transistors 201 and 203 are arranged as current mirror, only half of the current ($I_{TAIL}$) through the circuit of FIG. 2 can be pulled off of the PPG node.

Consequently, under the closed-loop approach of FIG. 1, during wake-up only about 40%-50% of the operational amplifiers tail current is used to discharge the PPG node from VEXT to the desired VB level. This section considers an open-loop approach during wake-up, where up to 100% of the tail current can be used to discharge the PPG node, reducing the wake-up time by about half. Also, a small detection circuit is added to sense the completion of the discharge of the PPG node, enabling closed loop regulation.

Figure 3:
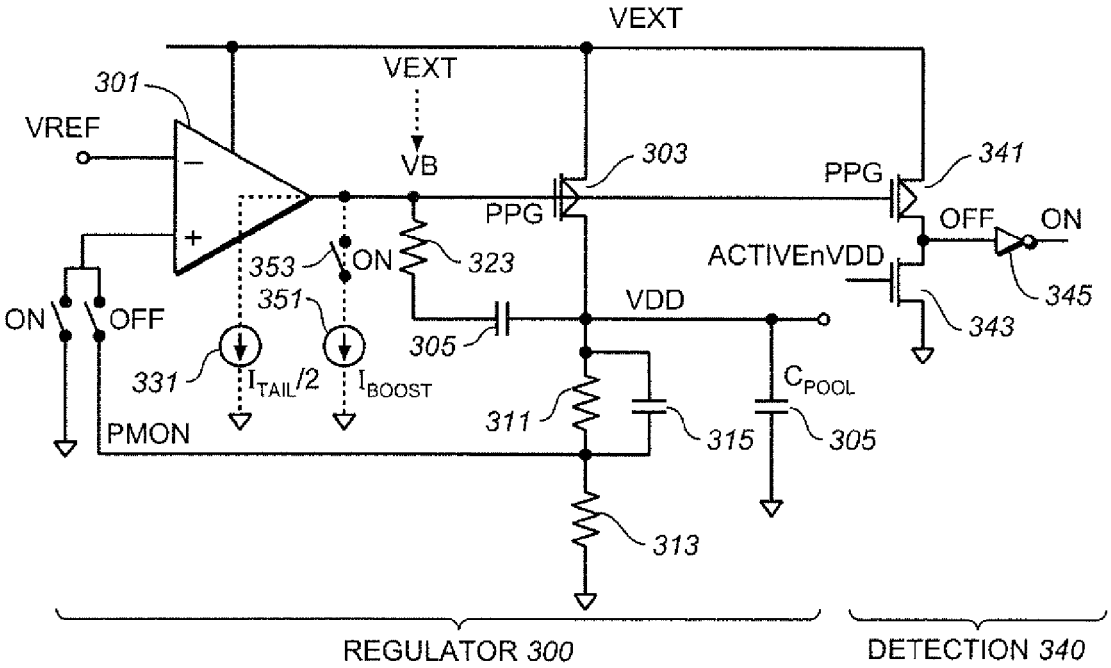
FIG. 3 is an exemplary embodiment of a regulator circuit with improved wake characteristics.

FIG. 3 illustrates an exemplary embodiment. An op-amp 301 again has its output connected to the gate of a power transistor 303 that is connected between VEXT and the output node to supply VDD. As in FIG. 1, the embodiment shown here again has a feedback node PMON from a node in divider formed of resistors 311 and 313 and capacitor 315, an output capacitor $C_{POOL}$ 305, and Miller compensation through the capacitor 321 and resistor 323; however, other arrangements can be used for this elements as the main aspects discussed here can be applied more generally. As before, a first of the op-amp's input is connected to a reference level VREF. Unlike FIG. 1, however, the second input of the op-amp 301 can either be connected to ground by a switch ON 347, leaving the feedback node PMON un-attached and at the level of the node between the elements 311 and 313 of the divider circuit, or be connected to receive the feedback at PMON by a switch OFF 349.

In addition to the regulator section 300, the system now also has a detection section 340 to provide the control signals of the switches ON 347 and OFF 349. In this embodiment, the detector section is made up of a PMOS transistor 341, whose gate is controlled the level at PPG, connected in series with an NMOS device 343 between VEXT and ground. The gate of the transistor 343 is connected to a control signal ACTIVEnVDD and which of the OFF 349 and ON 347 switches closed can be determined by the level at the node between transistors 341 and 343 (for OFF) and, through inverter 345, its inverse (for ON).

To improve wake-up response, after the PPG node is initialized to VEXT the + input is set to ground by the ON switch 347 to increase the current used to discharge the PPG node. (The OFF switch 349 is left open, leaving PMON to float at the on the divider chain.) This is schematically illustrated at the current 331 where the full tail current is used to discharge PPG. This provides for faster wake-up as 100% of $I_{TAIL}$ can now be used to discharge. The required area increase is small (in this embodiment, the switches OFF 349 and ON 347 and the PMOS, NMOS and inverter of detector 340) and the required extra power consumption required is low. It should be noted that this scheme can be used along with other wake-up schemes Although the op-amp is switched off during wake-up to make the regulator operate in an open loop, this is can be ignored since during wake-up the levels at PPG, VDD, and PMON are all in transition and the closed loop behavior has yet to be established.

In the detection section 340 of the system, the gate of the PMOS 341 is connected to the output of the op-amp 301 and the NMOS 343 connected to a control signal ACTIVEnVDD. The ACTIVEnVDD signal is high when disabled and low when enabled, including the wake-up operation. After resetting of PPG to VEXT, the device 341 turns off and the OFF node below it goes low, so that the ON switch 347 is closed and OFF switch 349 is opened. This open loop arrangement then allows for a faster response than the closed loop behavior in bringing down PPG toward the desired level of VB. ACTIVEnVDD then goes LOW so that as PPG drops down to the normal operation mode, this allows for the OFF signal to be pulled HIGH (and ON signal to go LOW), so that the op-amp 301 is connected back to the feedback loop at PMON. In the exemplary embodiment, ACTIVEnVDD is disabled automatically when the generator is enabled. This use of a detection circuit based on the level at PPG for setting the switches for the op-amp input allows for better tracking of device operation across processing corners. The operation of the detection circuit can be trimmed or determined by a user based upon the sizing of the PMOS 341.

Figure 4:
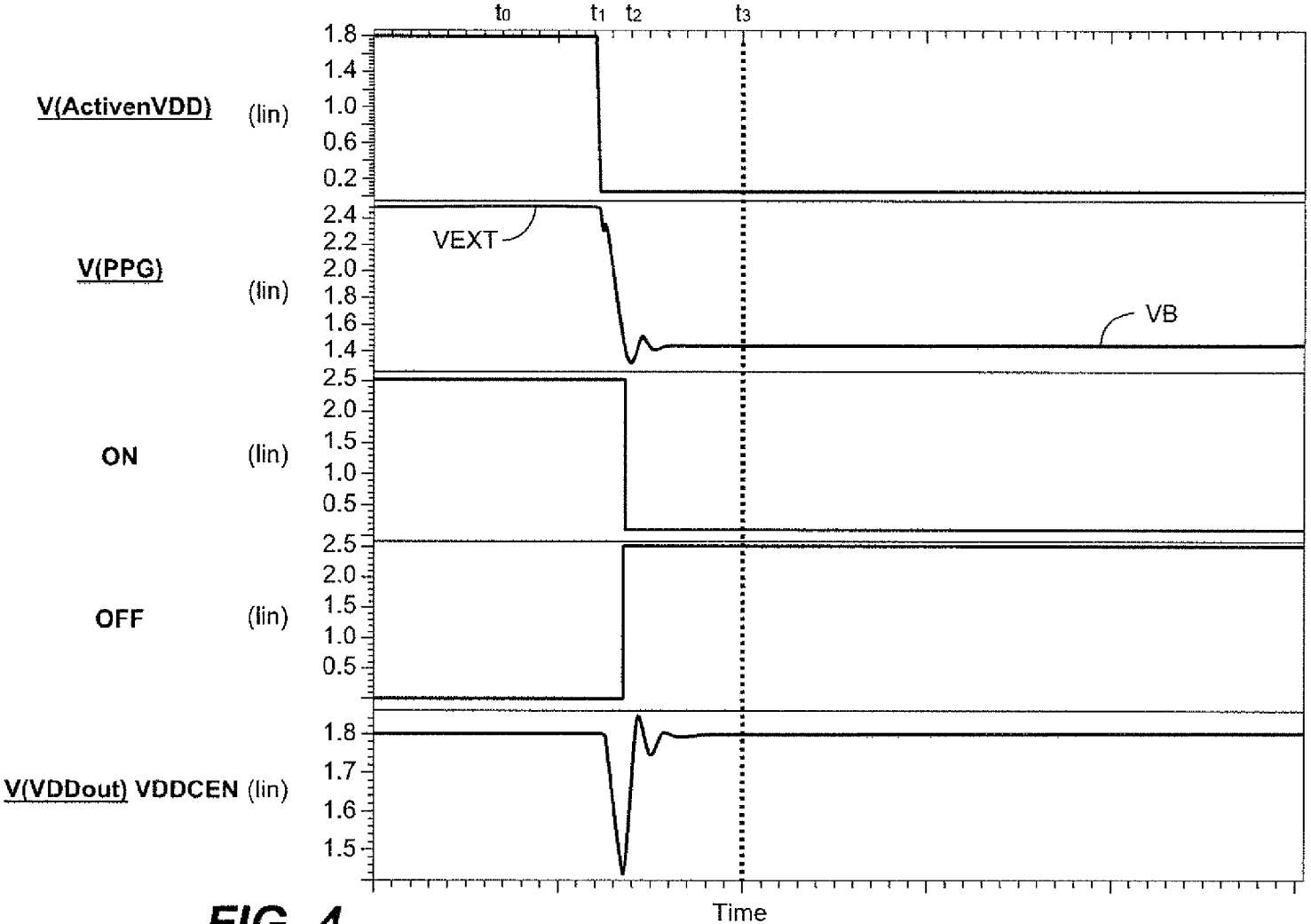
FIG. 4 illustrates

FIG. 4 illustrates this transition of the PPG node. Initially, at $t_0$, the level on the PPG node v(ppg) has to be set at VEXT and the level v(activenvdd) of ACTIVEnVDD is high. At this point, ON is high and OFF is low. At $t_1$, ACTIVEnVDD goes low and the PPG level begins to fall. When PPG has fallen sufficiently (at $t_2$), OFF is pulled high and ON goes low. After some initial fluctuation, the output v(vddout) settles down to regulation.

Also shown in the embodiment of FIG. 3 is an optional current sinking element 351 connected to PPG by a switch 353. (For example, this element can be implemented by a transistor.) This adds an extra tail current of $I_{BOOST}$ to increase the discharge current during the ON time, accelerating the wake-up response by more quickly pulling down the PPG node to have the desired level of VB. With or without the optional current sinking element 351, the techniques of this section can be also combined with other schemes to further improve wake-up behavior.

Shorting Scheme for Suspend-Resume

This section considers a complementary set of techniques that can be used for resuming operation of suspended regulation circuits. In general terms, when a regulation circuit comes back on and its output is needed for an operation, but has yet to come back up to the operating regulation level after being suspended, the output can be temporarily shorted to the supply level to speed up the process.

An example of where this situation can arise in the operation of non-volatile memory systems of a controller and one or more memory chips. During double data rate (DDR) operations, data-out operations can be susceptible to failure due to large internal power drops, such as would occur for the first data out DDR operation when a chip is enable for an insufficient time before the output clock starts toggling, or a data-out suspend-resume operation during which internal generators go into standby node. In such conditions, internal regulation circuits are not completely (due to their internal wake-up time) and any initial large current requirements would mainly be supplied by large pool capacitances. This section presents techniques for addressing this problem without the need of adding a large amount of pool capacitance.

More specifically, in a first set of aspects, to prevent power drop in the absence of regulators, the device shorts the internal power bus with the external power supply for a short duration, which can be trimmable. This scheme can provide for large initial currents without resort to increasing pool capacitance in the absence of regulation. This sort of an arrangement can have the side-effect that when the regulators are on, such as for data-out resume times being too short to go into a standby mode, the shorting of the internal bus to the external supply can cause an over-shoot for the internal power bus. Such an over-shoot can lead to an erroneous data out operation. In another set of aspects, to counter this side-effect, a detector circuit is used to detect when the data-out suspend resume time is less than the time needed to trigger going into standby more. This can mask the shorting pulse width if the regulator is on (avoiding overshoot) and unmask the pulse width when the regulator is off (to regulate internal power drop). This arrangement can provide a full solution to regulate internal power bus drop within design specifications for known marginal out data situations that could otherwise result in failure during DDR or other high speed operation, and in a way that can reduce die size by limiting requirements for large poop capacitances.

Figure 5:
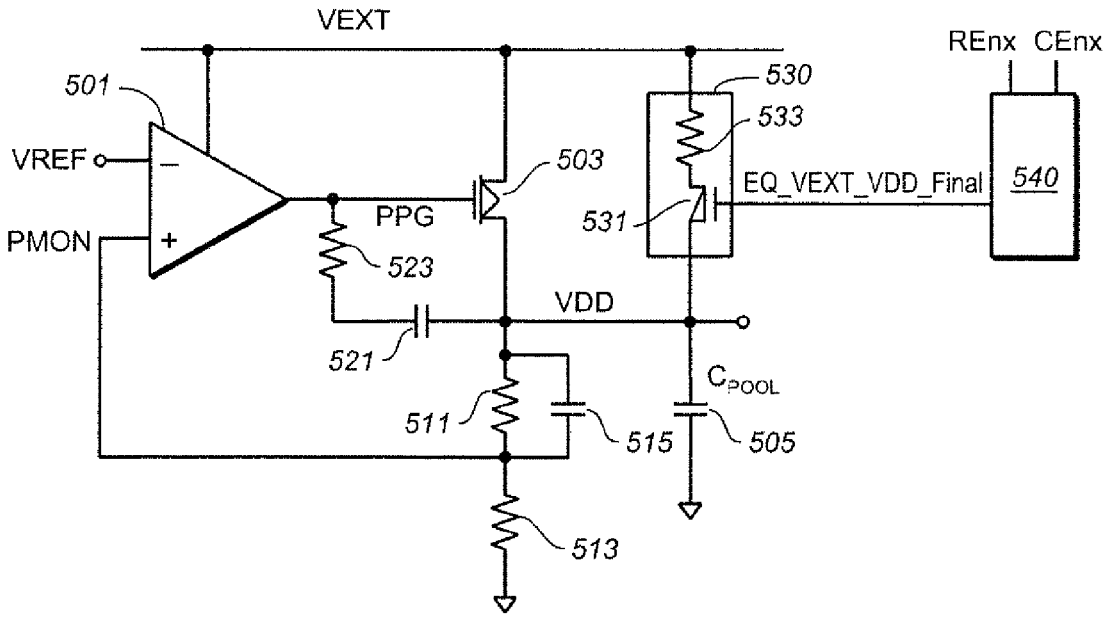
FIG. 5 is a schematic representation of a regulator circuit in which the shorting aspect can be implemented.

FIG. 5 is shows an example of a regulator circuit, where here the basic elements are similarly numbered (the op-amp 101 is now 501 and so on), but the techniques described are more general applicable to other designs. Added to the basic design is a sorting element 530 that can be used to selectively connected the output VDD to the supply level VEXT. Here a resistor 533 is connected in series with a PMOS device 531, but more generally other implementations can be used: for example, an NMOS device or even multiple individually controller devices. (Much of the circuit involved here can also be similar to what is presented in U.S. Pat. No. 7,372,320, and which can referred to for more detail on structure applicable here, except that in that case the control signal for the shorting operation was determined by a state machine based upon its knowledge of operations to be performed, where here a determining factor is the assertion of chip enable signal and whether or not the regulation circuit is active.) The transistor 531 is controlled by the signal EQ_VEXT_VDD_Final that will go low under this arrangement when the output is to be shorted. The control signal EQ_VEXT_VDD_Final is generated on the chip by some logic circuitry represented by the box 540 in response to the external signal enable the chip (CEnx) and a signal indicating that the regulator's output VDD will need (here a read enable signal REnx).

Figure 6:
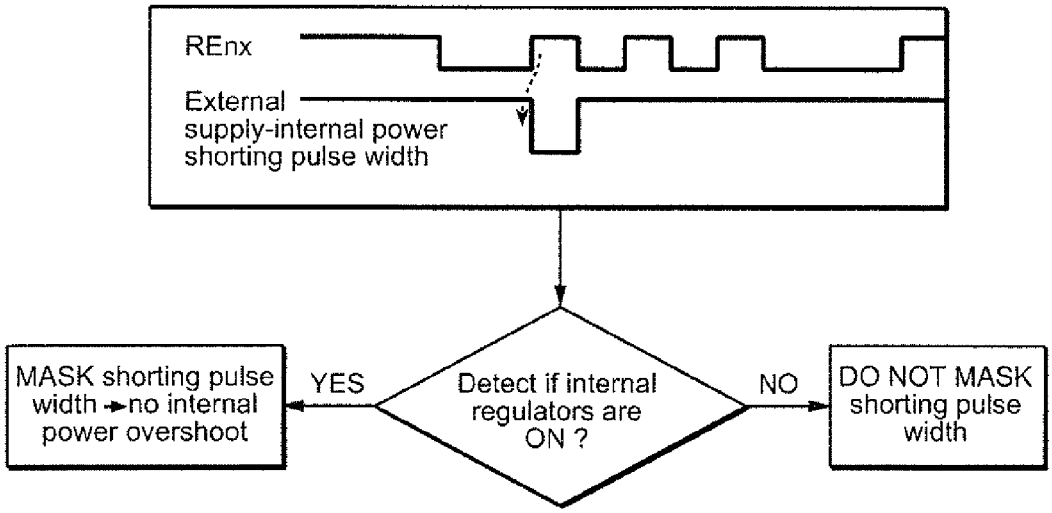
FIG. 6 provides a conceptually overview of the shorting process.

FIG. 6 provides a conceptual overview of the process. At top is shown a waveform for the read enable signal. When this is first asserted, an external (to the regulator) may be needed, so the control signal of the bottom line goes low. This short is only needed, though, if the needed regulators have been off (or, more generally, may require an output boost. This is shown by the decision under the pair of waveforms about whether or not to mask the control signal. It is this possibly masked version that is wanted here.

Figure 8:
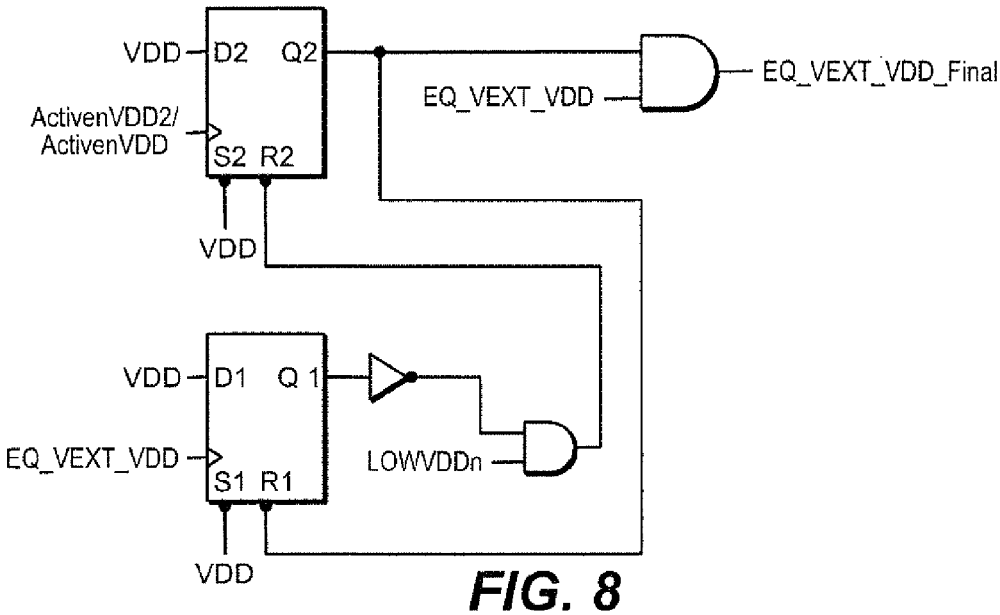
FIG. 8 shows an example of some logic circuitry for carrying out the timing of FIG. 7.
Figure 7:
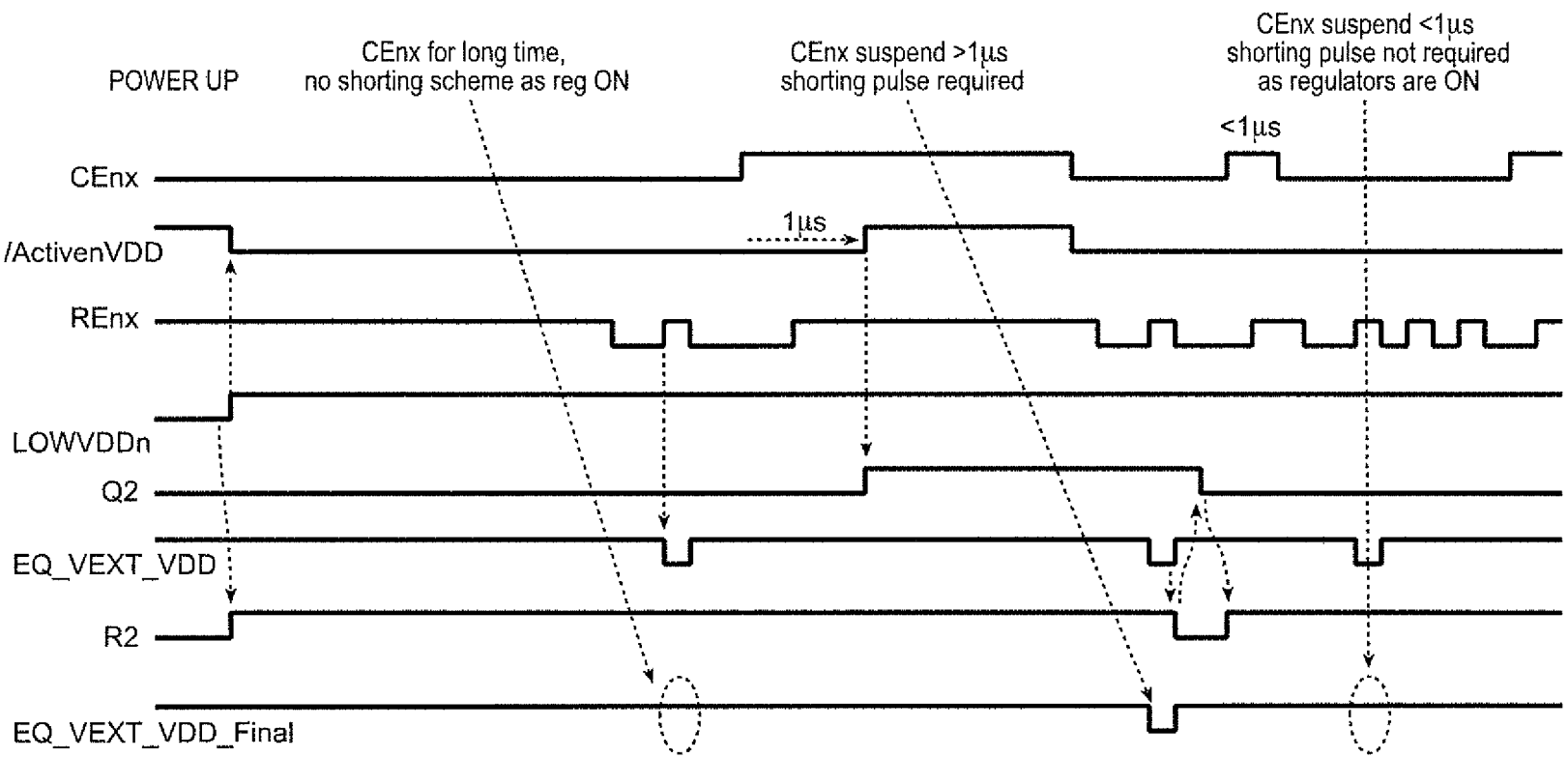
FIG. 7 is a more detailed timing diagram.

FIG. 7 is a more detailed timing diagram for generating the control signal for used for shorting the shorting pulse and FIG. 8 shows some corresponding logic circuitry for an exemplary embodiment. The top line of FIG. 7 shows a chip enable signal, here in inverted form CEnx, shown at top. Starting at power up, the chip is enabled initially for an extended period and the regulator is on. CEnx is then suspended for a while, after which the chip is enabled again, followed by a shorter period during which it is suspended. To avoid excessive stopping and starting due to short suspensions, the regulators are only shut down if the chip is disabled for over a certain period, which can be a trimmable, user settable value that is here taken as 1 μs. The second line of ActivenVDD indicates when the regulation circuit would be active (signal is LOW) or off (HIGH): following power up when the chip is enabled, the ActivenVDD goes low and the regulator is on; when the chip is suspended for more than delay value, ActivenVDD goes high and the regulator is turned off; and when the chip is suspended, but for less than the delay, ActivenVDD stays low and the regulator is on. The fourth line LOWVDDn goes low, and stays low, following power up once ActivenVDD drops.

In the exemplary embodiment, the circuit can be taken as a non-volatile memory chip and the regulation circuit's output can be used as a rad voltage. More generally, the read operation would be replaced with, say, a write operation or whatever operation will be using the output of the voltage regulator circuit. Here, the third line in FIG. 7 is the externally supplied (inverted) read enable signal REnx, which is low when reading is enable. From REnx, the signal EQ_VEXT_VDD is generated by going low the first time REnx goes high after time CEnx goes low. Note that EQ_VEXT_VDD consequently goes low in this situation whether or not CEnx was high for longer than the delay after which the regulator's operation is suspended. As discussed above, the shorted is wanted only when the regulator is suspended and then subsequently needed for an operation, such as the read case in this example. The wanted signal can then be generated by logic such as the example of FIG. 8.

The signals REnx and CEnx are received from off chip and from these the circuit internally generates ActivenVDD, LOWVDDn, and EQ_VEXT_VDD as just described. These three internally generated signals and VDD then serve as inputs for the logic circuitry of FIG. 8. Here this is formed of a pair of D flip-flops, an inverter, and a pair of AND gates, with the inputs connected as show, although other implementations can be used. The internal levels of Q2 and R2 are shown in FIG. 7. The result output of FIG. 8 is labelled as EQ_VEXT_VDD_Final and is the control signal used to short the regulator's output to VEXT. As shown at the bottom of FIG. 7, this signal goes low to enable shorting only when both the output is needed and the regulator has been turned off. Note that compared to the EQ_VEXT_VDD, the two case where EQ_VEXT_VDD went low, but the regulator had not been disabled, have been removed, leaving only the one case needed in this example.

The process described here has several delays or time intervals, including how long the shorting pulse lasts; how long the chip is disabled before the regulation circuit is shut down; and how long after the restating of the regulator being restart the pulse is needed. These values can be settable and user and user specification dependent. These intervals can have a duration or width that be set based on the specific design and controller by use of a parameter. The values can then be changed by a user (such as a NAND controller), but should adhere to JEDEC or other relevant timing specification guidelines.

CONCLUSION

The foregoing detailed description of the invention has been presented for purposes of illustration and description. It is not intended to be exhaustive or to limit the invention to the precise form disclosed. Many modifications and variations are possible in light of the above teaching. The described embodiments were chosen in order to best explain the principles of the invention and its practical application, to thereby enable others skilled in the art to best utilize the invention in various embodiments and with various modifications as are suited to the particular use contemplated. It is intended that the scope of the invention be defined by the claims appended hereto.

It is claimed:

1. A voltage regulation system, comprising:

a regulator section, including:

a power transistor connected between a supply level and an output of the voltage regulation system;

a feedback path to receive feedback from the output of the voltage regulation system;

an operational amplifier having first and second inputs and having an output connected to the gate of the power transistor, where the first input of the operational amplifier is connected to a reference level; and switching circuitry, whereby the second input of the operational amplifier is selectively connectable to either receive feedback from the feedback path or ground; and detection circuitry connected to the switching circuitry and to receive the output of the operational amplifier and an enable signal, whereby the second input of the operational amplifier is connected to ground when the enable signal is asserted and the voltage level on the output of the operational amplifier is above a first regulation level and is otherwise connected to receive the feedback, wherein the detection circuitry includes:

a first, p-type transistor connected between the supply level and an intermediate node, having a node connected to the output of the operational amplifier; and a second, n-type transistor connected between the intermediate node and ground, having a gate connected to receive the enable signal, wherein the switching circuitry is set based upon the level on the intermediate node.

2. The voltage regulation system of claim 1, wherein the voltage regulator section further includes:

a capacitance and a resistance connected in series between the output of the voltage regulation circuit and the output of the operational amplifier.

3. The voltage regulation system of claim 1, further comprising:

a current sinking circuit connected between the output of the operational amplifier and ground, wherein the current sinking circuit is enabled when the second input of the operational amplifier is connected to ground.

4. The voltage regulation system of claim 1, wherein the feedback path includes a voltage divider circuit through which the power transistor is connected to ground, where the output of the voltage regulation circuit is supplied form a node between the power transistor and the voltage divider and the feedback is taken from a node of the voltage divider circuit.

5. The voltage regulation system of claim 4, wherein the voltage divider circuit includes a first resistance connected between the output of the voltage regulation system and the feedback node and a second resistance connected between the feedback node and ground.

6. The voltage regulation system of claim 5, wherein the voltage divider circuit further includes a capacitance in parallel with the first resistance.

7. The voltage regulation system of claim 1, wherein the enable signal is asserted as part of a reset process subsequently to initializing the output of the operational amplifier to the supply level.

8. The voltage regulation system of claim 1, wherein the first regulation level is trimmable.

9. A voltage regulation system, comprising:

a regulator section, including:

a power transistor connected between a supply level and an output of the voltage regulation system;

a feedback path to receive feedback from the output of the voltage regulation system;

an operational amplifier having first and second inputs and having an output connected to the gate of the power transistor, where the first input of the operational amplifier is connected to a reference level; and switching circuitry, whereby the second input of the operational amplifier is selectively connectable to either receive feedback from the feedback path or ground; and detection circuitry connected to the switching circuitry and to receive the output of the operational amplifier and an enable signal, whereby the second input of the operational amplifier is connected to ground when the enable signal is asserted and the voltage level on the output of the operational amplifier is above a first regulation level and is otherwise connected to receive the feedback, whereby when the second input of the operational amplifier is connected to ground, the full current level though the operational amplifier is discharging the output of the operational amplifier.

10. A method of resetting a voltage regulation circuit, the voltage regulation circuit including a power transistor connected between a supply level and the output node of the voltage regulation circuit, and an operational amplifier having first and second inputs and having an output connected to the gate of the power transistor, where the first input of the operational amplifier is connected to a reference level and wherein the voltage regulation circuit is part of a system including detection circuitry comprising: a first, p-type transistor connected between the supply level and an intermediate node, having a node connected to the output of the operational amplifier; and a second, n-type transistor connected between the intermediate node and ground, having a gate connected to receive an enable signal, wherein the second input of the operation amplifier is set based upon the level on the intermediate node, the method comprising:

setting the output of the operational amplifier to the supply level;

subsequently setting the second input of the operational amplifier to ground;

while the second input of the operational amplifier is connected to ground, determining when the output voltage of the operational amplifier falls below a regulation level; and in response to the output voltage of the operation falling below the first regulation level, connecting the second input of the operation amplifier to receive feedback from the output of the voltage regulation circuit.

11. The voltage regulation system of claim 10, wherein the voltage regulation circuit further includes a capacitance and a resistance connected in series between the output of the voltage regulation circuit and the output of the operational amplifier.

12. The voltage regulation system of claim 10, further comprising:

enabling a current sinking circuit connected between the output of the operational amplifier and ground enabled when the second input of the operational amplifier is connected to ground.

13. The voltage regulation system of claim 10, wherein the feedback path includes a voltage divider circuit through which the power transistor is connected to ground, where the output of the voltage regulation circuit is supplied form a node between the power transistor and the voltage divider and the feedback is taken from a node of the voltage divider circuit.

14. The method of claim 13, wherein the voltage divider circuit includes a first resistance connected between the output of the voltage regulation system and the feedback node and a second resistance connected between the feedback node and ground.

15. The method of claim 14, wherein the voltage divider circuit further includes a capacitance in parallel with the first resistance.

16. The voltage regulation system of claim 10, wherein the first regulation level is trimmable.

17. The voltage regulation system of claim 10, where when the second input of the operational amplifier is connected to ground, the full current level though the operational amplifier is discharging the output of the operational amplifier.

18. A method of operating a voltage regulation circuit forming a component of an integrated circuit, the voltage regulation circuit connected between a supply voltage and ground and connected to receive a reference voltage and generate therefrom a regulated output voltage at an output node, the method comprising:

receiving a chip enable signal at the integrated circuit;

in response to the chip enable signal being asserted, determining whether the voltage regulation circuit is active;

in response to determining that the voltage regulation circuit is not active, activating the voltage regulation circuit;

subsequently to the enable signal being asserted, receiving at the integrated circuit a command to perform an operation using the regulated output voltage;

determining whether the command is received within a first interval after activating the voltage regulation circuit; and in response to the command being received within the first interval, shorting the output node to the supply voltage, wherein determining whether the voltage regulation circuit is active comprises determining whether, prior to chip enable signal being enabled, the chip enable signal had been de-asserted for a period greater than a second interval.

19. The method of claim 18, further comprising:

disconnecting the output node from the supply voltage after a second interval elapses after the shorting thereof.

20. The method of claim 19, wherein the duration of the second interval is a user settable parameter.

21. The method of claim 18, wherein the duration of the first interval is a user settable parameter.

22. The method of claim 18, wherein the output node is connected to the supply voltage through one or more transistors and said shorting includes turning on one or more the transistors.

23. The method of claim 18, wherein the duration of the second interval is a user settable parameter.

24. The method of claim 18, wherein the command is for a read operation.

25. The method of claim 18, wherein the command is for a write operation.

26. The method of claim 18, wherein the voltage regulation circuit includes an operational amplifier having a first input connected to receive the reference voltage and a second input connected to receive feedback from the output node.

* * * * *

UNITED STATES PATENT AND TRADEMARK OFFICE

CERTIFICATE OF CORRECTION

PATENT NO. : 8,710,914 B1
APPLICATION NO. : 13/762627
DATED : April 29, 2014
INVENTOR(S) : Guhados et al.

It is certified that error appears in the above-identified patent and that said Letters Patent is hereby corrected as shown below:

In the Claims

Column 7, Claim 4, line 46, please delete "form" and insert -- from --.

Column 8, Claim 13, line 64, please delete "form" and insert -- from --.

Signed and Sealed this
Thirtieth Day of September, 2014

Michelle K. Lee

Michelle K. Lee
*Deputy Director of the United States Patent and Trademark Office*